US007988898B2

(12) United States Patent
White et al.

(10) Patent No.: US 7,988,898 B2
(45) Date of Patent: Aug. 2, 2011

(54) METHOD OF MANUFACTURING A BOWLING PIN

(75) Inventors: Wayne White, Lowville, NY (US); Joe Infantino, Chappaqua, NY (US); Rodney C. Mallette, Brantingham, NY (US); Ron Mizzi, Glenfield, NY (US)

(73) Assignee: QUBICAAMF Worldwide LLC., Mechanicsville, VA (US)

( * ) Notice: Subject to any disclaimer, the term of this patent is extended or adjusted under 35 U.S.C. 154(b) by 657 days.

(21) Appl. No.: 11/551,522

(22) Filed: Oct. 20, 2006

(65) Prior Publication Data

US 2008/0096680 A1 Apr. 24, 2008

(51) Int. Cl.

| | |
|---|---|
| ***B29B 13/00*** | (2006.01) |
| ***B29B 7/00*** | (2006.01) |
| ***B29C 45/14*** | (2006.01) |
| ***B29C 45/00*** | (2006.01) |
| ***C08J 5/00*** | (2006.01) |
| *A63D 9/00* | (2006.01) |

(52) U.S. Cl. ..... 264/278; 264/328.1; 264/331.15; 264/271.1; 264/274; 264/277; 264/279; 473/118; 473/119

(58) Field of Classification Search ..... None
See application file for complete search history.

(56) References Cited

U.S. PATENT DOCUMENTS

| | | | | |
|---|---|---|---|---|
| 1,603,880 | A * | 10/1926 | Smith | 473/119 |
| 3,044,777 | A | 7/1962 | Friedman | |
| 3,201,124 | A * | 8/1965 | Halip | 473/119 |
| 3,206,207 | A * | 9/1965 | Hansen | 473/123 |
| 4,012,386 | A | 3/1977 | Davis | |
| 4,165,875 | A | 8/1979 | Dykehouse | |
| 4,210,992 | A * | 7/1980 | Murray | 29/525 |
| 4,457,511 | A * | 7/1984 | Witkowski | 473/119 |
| 4,762,737 | A | 8/1988 | Lu | |
| 4,793,614 | A | 12/1988 | Laure | |
| 5,274,041 | A * | 12/1993 | Yamada | 525/196 |
| 5,789,475 | A * | 8/1998 | Chen | 524/300 |
| 6,196,928 | B1 | 3/2001 | Jaeger | |
| 6,790,401 | B2 | 9/2004 | Yasuo | |
| 2003/0109317 | A1 * | 6/2003 | Yasuo | 473/119 |

FOREIGN PATENT DOCUMENTS

| | | |
|---|---|---|
| GB | 1046854 | 10/1966 |
| GB | 1046854 A * | 10/1966 |

OTHER PUBLICATIONS

DuPont, Surlyn® thermoplastic resins: Product and Properties Overview, Aug. 2000.*
"USBC Tenpin Specification" pp. 19-30, Jan. 2005.
"Surlyn® 8920 thermoplastic resin" pp. 1-3, 2002.

* cited by examiner

*Primary Examiner* — Christina Johnson
*Assistant Examiner* — Benjamin Schiffman
(74) *Attorney, Agent, or Firm* — Andrew M. Calderon; Roberts Mlotkowski Safran & Cole, P.C.

(57) ABSTRACT

A bowling pin including a body having a head, a neck, a ball line portion, and a base all integrally formed of a synthetic material. The body includes a hollow area and a longitudinal axis of the hollow area extends generally perpendicularly to a substantially planar bottom surface of the base. A method of manufacturing a bowling pin includes providing a mold shell having a mold cavity shaped substantially as a bowling pin, disposing a mandrel inside a mold cavity, introducing material into the mold cavity, cooling the material inside the mold cavity, removing the mandrel from the mold cavity, removing the material from the mold cavity, and cooling the material outside the mold cavity.

23 Claims, 11 Drawing Sheets

METHOD OF MANUFACTURING A BOWLING PIN

FIELD OF THE INVENTION

The present invention relates to bowling pins, and more particularly to synthetic bowling pins and a method of manufacturing such bowling pins.

DISCUSSION OF BACKGROUND INFORMATION

Bowling pins have historically been manufactured from wood, some of which are made entirely of wood. In most modern manufacturing methods, though, the pin is manufactured with a wood core and a plastic outer shell. However, it is not surprising, then, that wood remains the basis for almost all pin manufacturing since such methods are known to meet specifications that are currently required by the United States Bowling Congress (USBC).

The manufacture of wood-based pins, however, is time consuming since it is not easy to form wood into the unique shape and mass of a bowling pin. For example, a typical method of manufacture involves: drying and aging the wood, laminating pieces of wood together, turning the laminate into the shape of a pin, and then applying a plastic coating. Although this is time consuming, using these methods it is possible to attain a bowling pin which satisfies the most discerning and experienced bowlers, i.e., one that has the feel, look and sound of a traditional bowling pin.

For a pin manufactured of a different material to be satisfactory and attain widespread use, it must possess the many diverse characteristics of a traditional wood-based bowling pin. At a minimum, for example, the bowling pin must comply with the standards set by various competitive bowling organizations. These industry standards, such as those promulgated by the United States Bowling Congress, include exacting specifications for height, diameter at numerous locations and weight.

Beyond the well-defined dimensional standards, pins must also possess certain aesthetic qualities since bowlers have grown accustomed to the "look" and "sound" of traditional wood-based bowling pins. For example, the bowling pin must have a visual appearance that is similar to a conventional wood-based pin, have a pleasing sound when struck by a bowling ball or another pin, and have good action, i.e., an appropriate amount of bounce when struck by a bowling ball or another pin.

Manufacturing a synthetic bowling pin is no easy task, taking into consideration the exacting standards required (i.e., size, shape, weight, center of gravity, appearance, sound, action, and cost-effectiveness). In fact, the manufacture of a synthetic bowling has proven quite difficult, in that previous attempts have fallen short in meeting all of the standard requirements.

Accordingly, there is a need for an synthetic bowling pin that overcomes the above deficiencies.

SUMMARY OF THE INVENTION

According to a first aspect of the invention, a bowling pin comprises a body comprising a head, a neck, a ball line portion, and a base all integrally formed of a synthetic material. The bowling pin may further comprise a hollow area formed during the molding process. The body forms an exposed exterior surface of the bowling pin. A longitudinal axis of the hollow area extends generally perpendicularly to a substantially planar bottom surface of the base. The hollow area extends from the bottom surface into the body. This hollow area comprises a generally conical shape with a sidewall having a generally constant gradient along a majority of an axial length of the hollow area.

Furthermore, an upper end of the hollow area may terminate inside the body. An insert may be disposed within the upper end of the hollow area. An axial length of the insert may be less than half the axial length of the hollow area. The insert may comprise at least one of polycarbonate, fiberglass-reinforced epoxy, fiberglass-reinforced thermosetting polyester, nylon, parallam, glass-filled nylon, aluminum, wood and wood-based materials. The upper end of the hollow area may terminate at or above the neck. The insert may have a lock-in device that engages the body.

Additionally, the bowling pin may further comprise a base attachment that is removably connected to the body such that it may be removed and replaced as needed.

Even further, the synthetic material may comprise ethylene-methacrylic acid copolymer. Also, the bowling pin may comprise a center of gravity at a height in the range of approximately 5.625 inches to 5.937 inches, a total height in the range of approximately 14.969 inches to 15.031 inches, and a weight in the range of approximately 3.375 pounds to 3.625 pounds.

In a second aspect of the invention, there is a method of manufacturing a bowling pin comprising providing a mold shell having a mold cavity shaped substantially as a bowling pin, disposing a mandrel inside a mold cavity, and introducing material into the mold cavity. The method further comprises cooling the material inside the mold cavity, removing the mandrel from the mold cavity, removing the material from the mold cavity, and cooling the material outside the mold cavity. The material is formed into a body comprising a generally conical internal hollow area and an exposed exterior surface of the bowling pin.

Disposing the mandrel inside the mold cavity may comprise removal of the entire mandrel or installation of an insert. This is achieved by connecting an insert to the mandrel prior to disposing the mandrel inside the mold cavity. Removing the mandrel from the mold cavity may comprise disconnecting the insert from the mandrel such that the insert is not removed from the material.

Cooling the material inside the mold cavity may comprise introducing coolant into at least one passage contained within the mandrel. Cooling the material inside the mold cavity may further comprise introducing other coolant into at least one passage contained within the mold shell.

Introducing the material may comprise injecting a synthetic material into the mold cavity. The material may comprise ethylene-methacrylic acid copolymer.

Removing the mandrel from the mold cavity may comprise applying a force with a hydraulic device. The method may further comprise attaching a removable base attachment to the material.

In a third aspect of the invention, there is a bowling pin comprising a body having a head, a neck, a ball line portion, and a base all integrally formed of a synthetic material. The bowling pin further comprises a hollow area, disposed within the body, having a termination within the body and a longitudinal axis substantially perpendicular to a substantially planar surface of the base. The bowling pin also comprises a base attachment connected to the base, and may have an insert disposed within the hollow area at the termination. The body forms an exposed exterior surface of the bowling pin.

The bowling pin may have a center of gravity at a height in the range of approximately 5.625 inches to 5.937 inches. The bowling pin may have a height in the range of approximately 14.969 inches to 15.031 inches. The bowling pin may have a weight in the range of approximately 3.375 pounds to 3.625 pounds.

The body may comprise ethylene-methacrylic acid copolymer. The neck insert may comprise at least one of polycarbonate, fiberglass-reinforced epoxy, fiberglass-reinforced thermosetting polyester, nylon, parallam, glass-filled nylon, aluminum, wood and wood based materials. The insert may have a lock-in device that engages the body. The base attachment may be designed such that it can be removed and replaced as needed.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF EMBODIMENTS OF THE INVENTION

The present invention is directed to a synthetic bowling pin and method of manufacturing. In one aspect of the invention, the bowling pin of the invention is a bowling pin of synthetic material which complies with accepted tolerances for height, diameter at various locations, weight, center of gravity, and coefficient of restitution. Furthermore, the bowling pin of the invention possesses a pleasing visual appearance, sound, and action, and is cost efficient for the proprietor. The purchase price may be significantly higher but a longer life span will result in a savings to the proprietor.

In another aspect of the invention, a removable base attachment for a bowling pin is provided. The removable feature of the base attachment reduces operating costs by allowing replacement of individual parts instead of the entire pin. In a further aspect of the invention, a method of manufacture of a synthetic bowling pin is provided. The method allows for the relatively quick and simple manufacture of bowling pins that meet conventional requirements.

Figure 1:
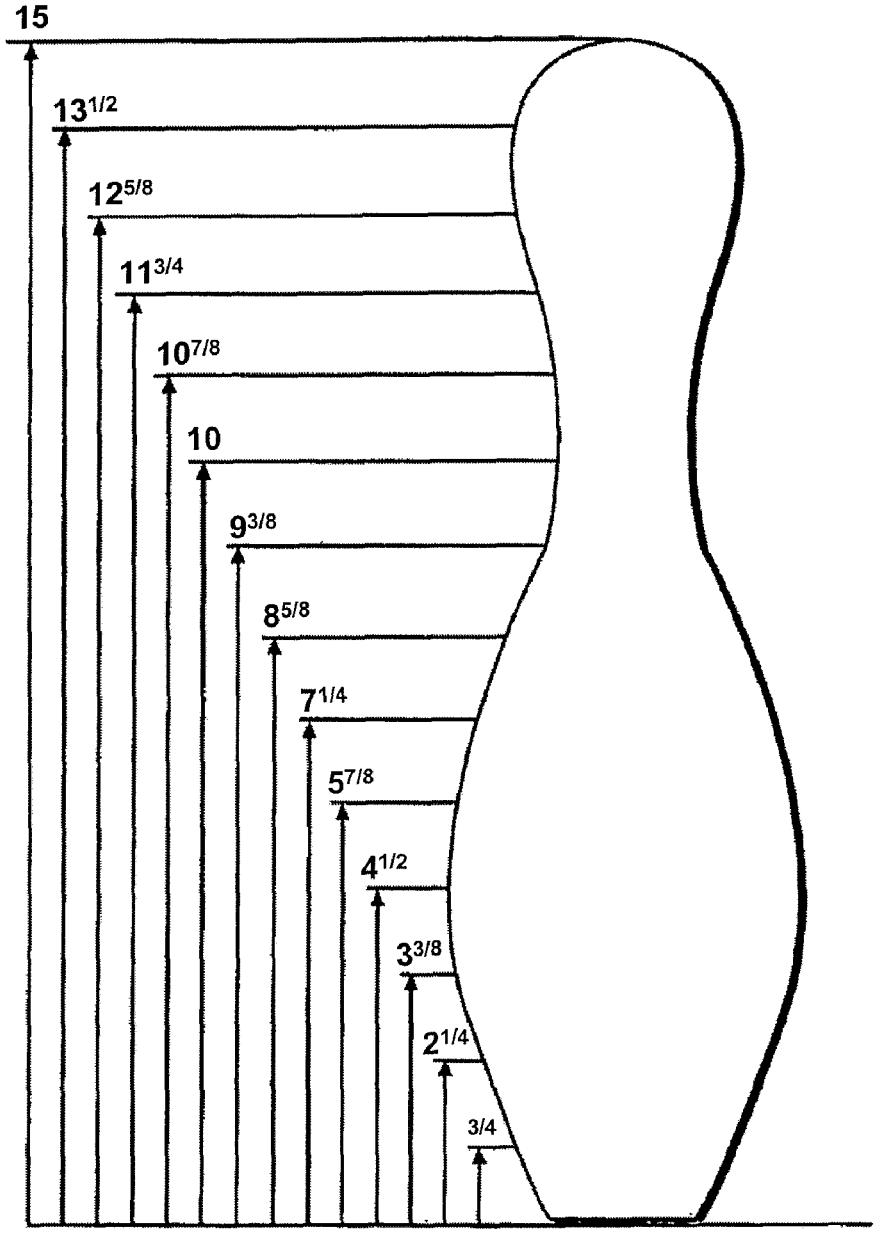
FIG. 1 shows a schematic of a bowling pin detailing dimensions in accordance with an embodiment of the invention.

The bowling pin of the present invention may have any desired external size and shape. However, referring to FIG. 1, implementations of the bowling pin of the present invention may conform to the dimensions of a regulation bowling pin in accordance with the bowling pin measurement specifications promulgated by the United States Bowling Congress (USBC).

For example, the regulation bowling pin, when standing upright, has an overall height of approximately 15 inches with a tolerance of plus or minus 0.031 inches. At a height of approximately ¾ inches, the regulation bowling pin has a diameter of approximately 2.828 inches. At a height of approximately 2 and ¼ inches, it has a diameter of approximately 3.906 inches. At a height of approximately 3 and ⅜ inches, it has a diameter of approximately 4.510 inches. At a height of approximately 4 and ½ inches, it has a diameter of approximately 4.766 inches. At a height of approximately 5 and ⅞ inches, it has a diameter of approximately 4.563 inches. At a height of approximately 7 and ¼ inches, it has a diameter of approximately 3.703 inches. At a height of approximately 8 and ⅝ inches, it has a diameter of approximately 2.472 inches. At a height of approximately 9 and ⅜ inches, it has a diameter of approximately 1.965 inches. At a height of approximately 10 inches, it has a diameter of approximately 1.797 inches. At a height of approximately 10 and ⅞ inches, it has a diameter of approximately 1.870 inches. At a height of approximately 11 and ¾ inches, it has a diameter of approximately 2.094 inches. At a height of approximately 12 and ⅝ inches, it has a diameter of approximately 2.406 inches. At a height of approximately 13 and ½ inches, it has a diameter of approximately 2.547 inches. Each of the diameters has a tolerance of +/− about 0.031 inches. Furthermore, the regulation bowling pin weighs at least approximately 3.375 pounds and not more than approximately 3.625 pounds. Even further, the regulation bowling pin has a center of gravity at a height of between approximately 5.625 inches and approximately 5.937 inches.

Figure 2:
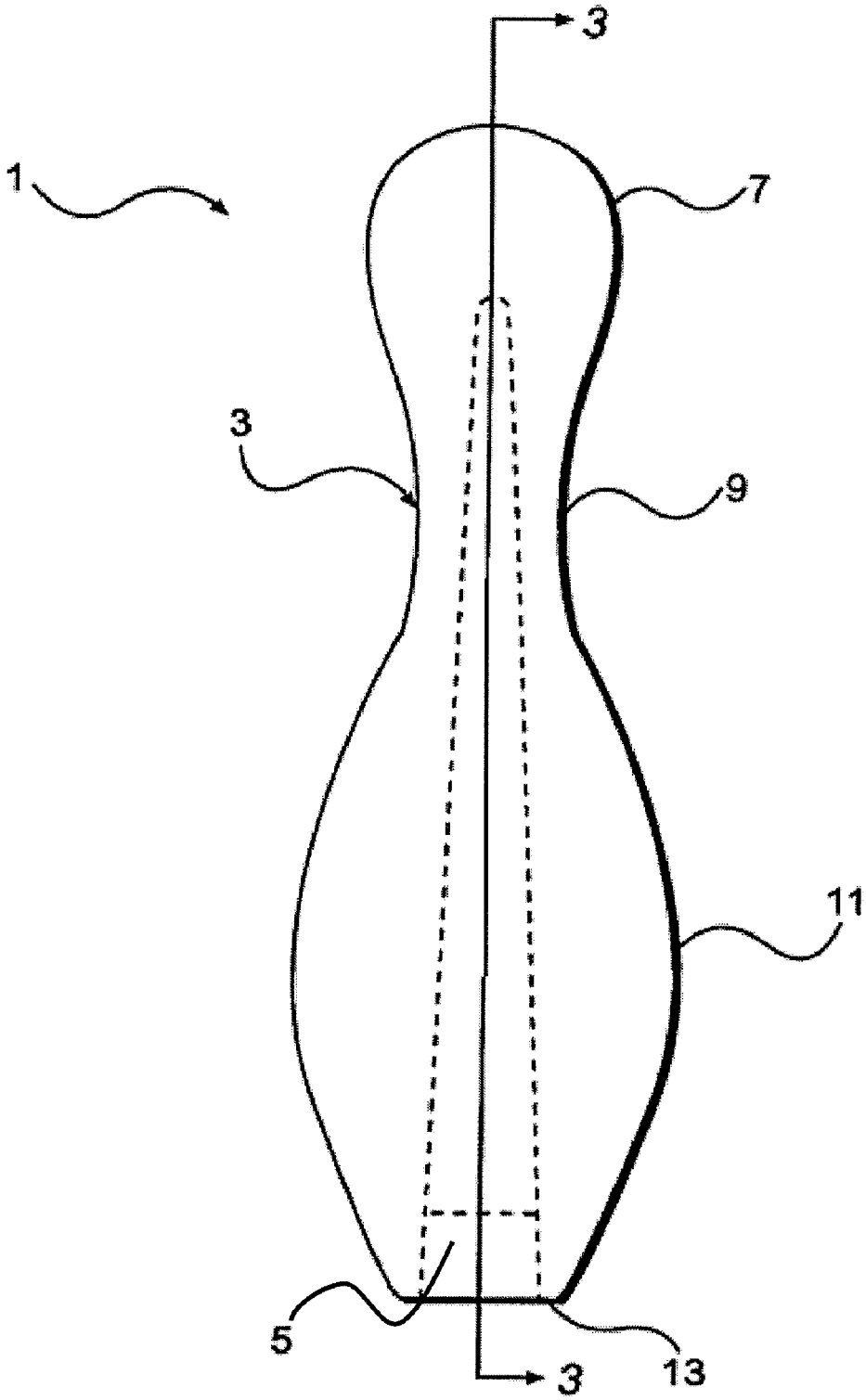
FIG. 2 shows a bowling pin in accordance with the invention.

Referring to FIG. 2, the bowling pin 1 of the present invention is shown having a body 3 and a base attachment 5. The body 3 includes a head 7, neck 9, ball line portion (e.g., belly) 11, and a base 13. The head 7 and ball line portion 11 have convex outer surfaces. The base 13 further includes a generally planar bottom. The neck 9 has a curved outer surface and smoothly connects the head 7 and ball line portion 11. The base attachment 5 is removably connected to the base 13, as described below.

Figure 3A:
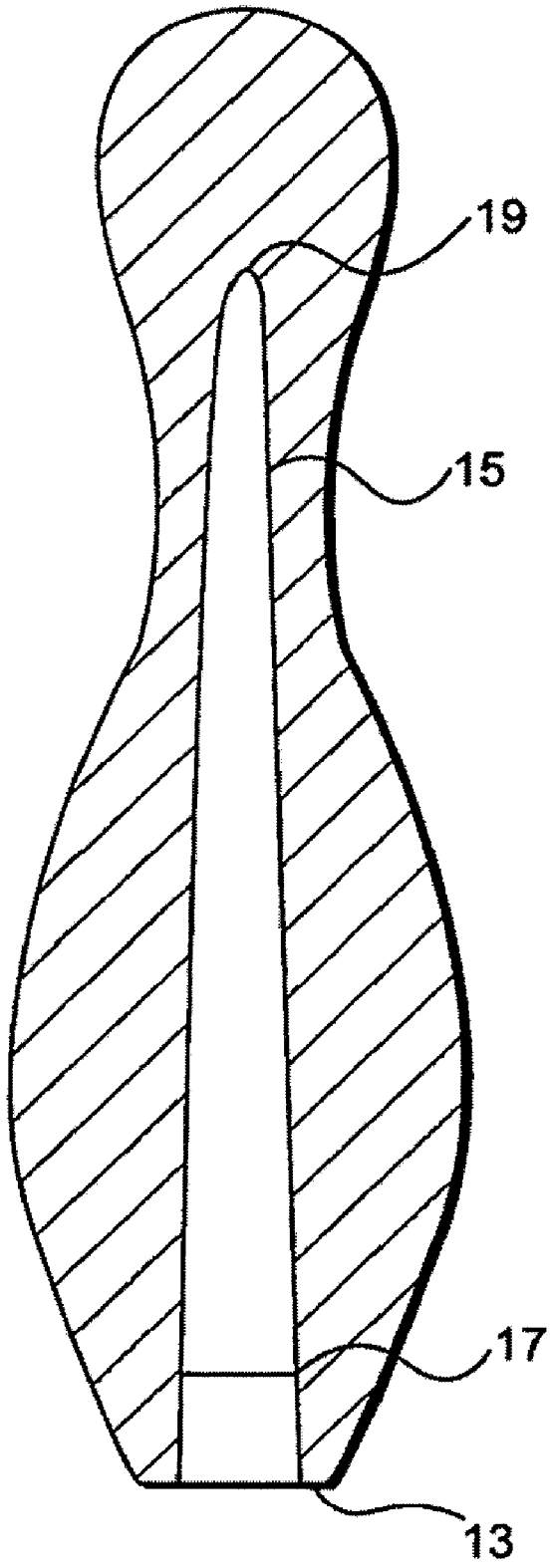
FIG. 3A shows a cross-sectional view along line 3-3 of FIG. 2 without a neck insert.

As shown in FIG. 3A, a hollow area 15 extends along a substantial portion of the length of the body 3 and is coaxial with the longitudinal axis of revolution of the body 3. The hollow area 15 is generally perpendicular to the flat bottom of the base 13. The hollow area 15 can be any size and shape, and is advantageously used to control pin characteristics such as the distribution of mass throughout the pin, weight, center of gravity, and neck strength. For example, the topmost termination of the hollow area 15 may be located in any of the ball line portion 11, neck 9, or head 7.

In embodiments, the hollow area 15 has a generally conical shape with a sidewall that has a generally constant gradient along a majority of the length of the hollow area 15. For example, the hollow area 15 may have a diameter of approximately 1.6 inches at the bottom of the base 13, and maintain a roughly constant diameter of about 1.6 inches for a length of approximately 0.75 inches inward from the bottom to a first transition 17. The hollow area 15 extends from the first transition 17 to a termination point 19 inside the body 3. In embodiments, the termination point 19 has a diameter of approximately 0.625 inches. The hollow area 15 preferably has a length of approximately 14 inches.

Figure 3B:
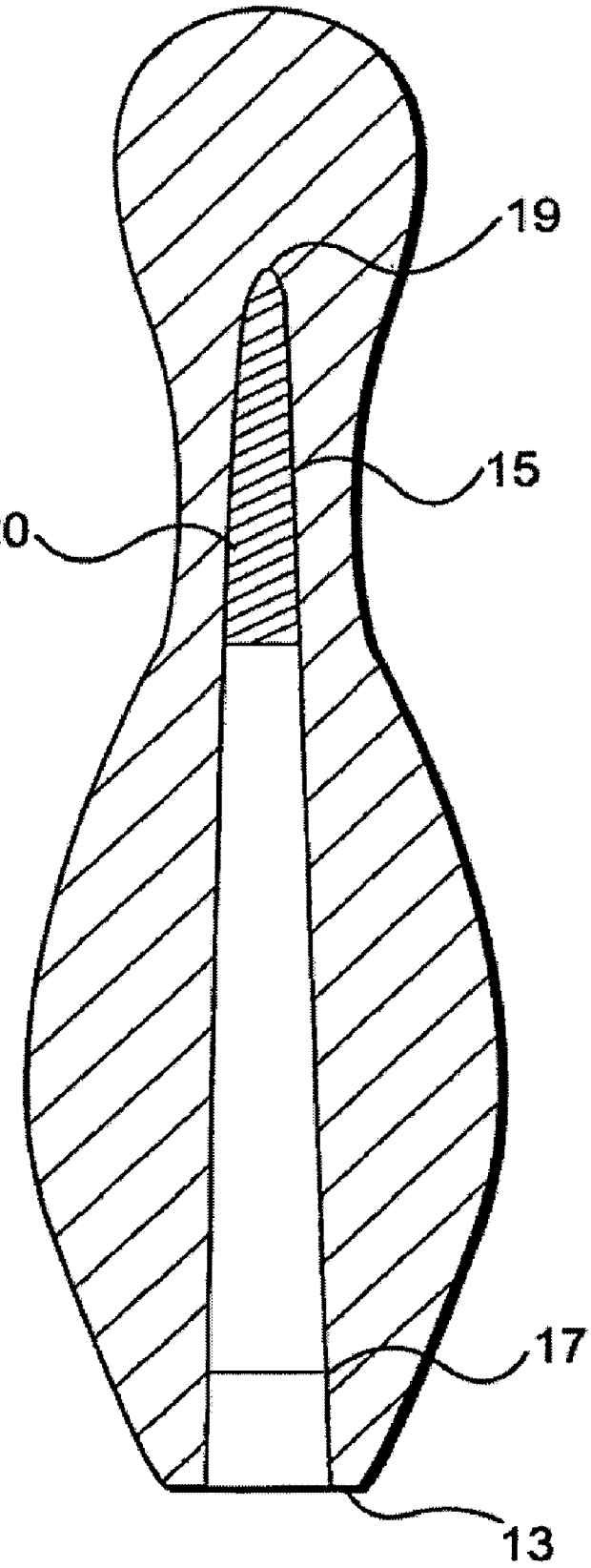
FIG. 3B shows a cross-sectional view along line 3-3 of FIG. 2 with a neck insert.

FIG. 3B shows the pin 1 with an optional neck insert 20 disposed in the hollow area 15. In embodiments, the neck insert 20 may be disposed in the hollow area 15 in order to adjust various characteristics of the pin. For example, the size, shape, weight, and material of the neck insert 20, and the location of the neck insert 20 within the pin 1, may affect pin characteristics such as neck strength, mass distribution (e.g., center of gravity), and weight. Accordingly, the neck insert 20 may be any desired size, shape, weight, material, and may be disposed at any desired location in the pin 1 as required by the intended use of the pin. More specifically, the neck insert 20 may be designed and located within the body such that the pin as a whole has a weight in the range of about 3 pounds and 6 ounces to about 3 pounds 10 ounces.

Figure 3C:
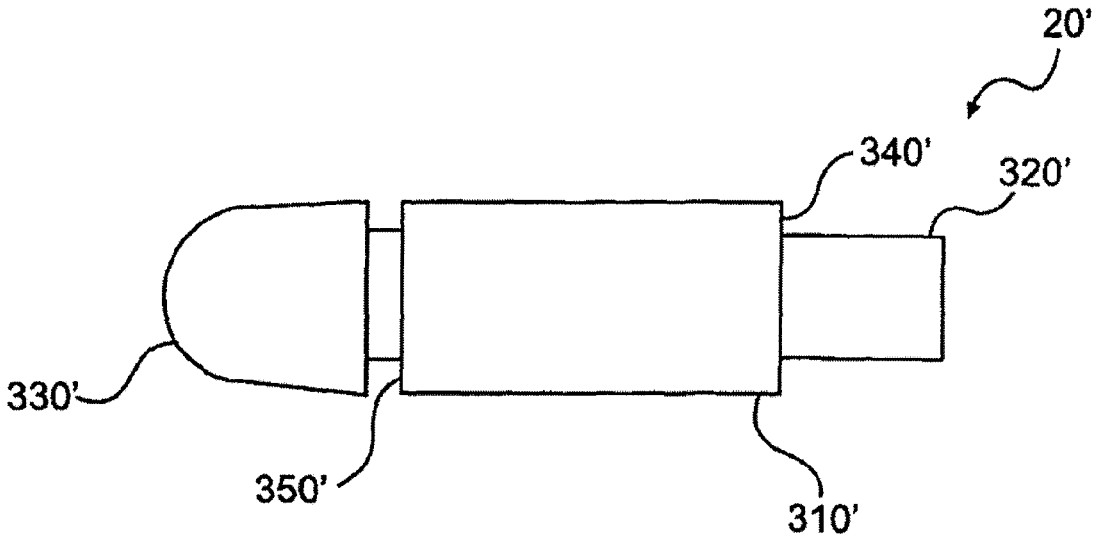
FIGS. 3C and 3D show neck inserts according to aspects of the invention.
Figure 3D:
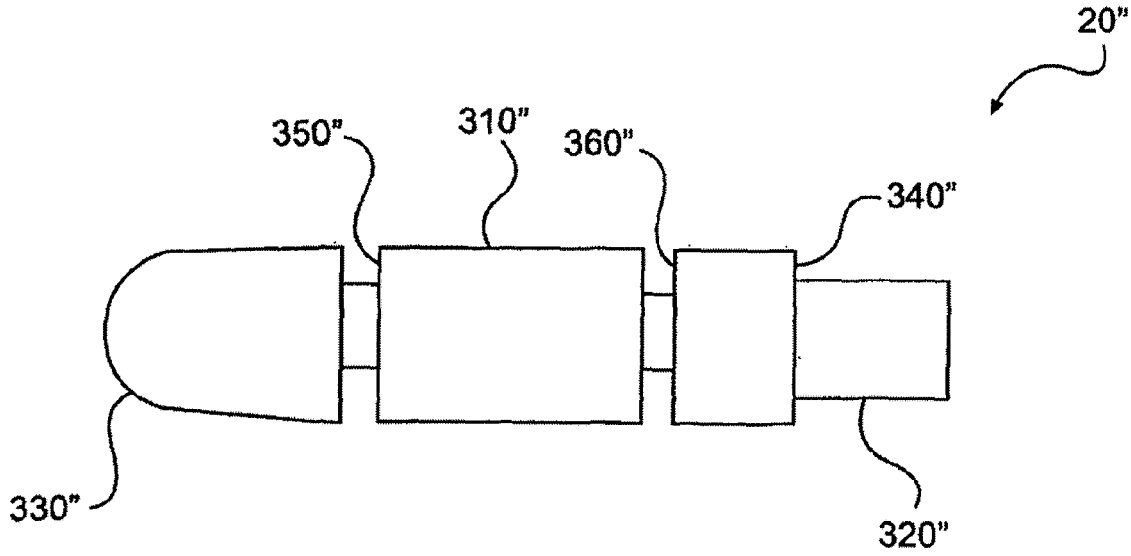

FIGS. 3C and 3D show exemplary embodiments of the neck insert 20 according to the invention. In FIG. 3C, a first embodiment of the neck insert (indicated by 20') is shown having a substantially cylindrical body 310' and a substantially cylindrical extension 320'. The end of the body 310' opposite the extension 320' includes a rounded portion 330'. The extension 320' has a smaller diameter than the body 310', resulting in a shoulder 340' at the junction of the extension 320' and body 310'. The body 310' also comprises an annular groove 350' located between the rounded portion 330' and the shoulder 340'.

In a preferred embodiment of the neck insert 20' shown in FIG. 3C, the body 310' has an outer diameter of approximately 1.350 inches and a length of approximately 4.606 inches from the shoulder 340' to the tip of the rounded portion 330'. Additionally, the extension 320' has an outer diameter of approximately 0.875 inches and a length of approximately 1.250 inches, and is coaxial with the body 310'. Also, the annular groove 350' has a width of approximately 0.187 inches, a depth of approximately 0.180 inches, and is disposed approximately 2.824 inches from the shoulder 340'. In embodiments, the annular groove 350' acts as a lock-in device that engages the material of the body to affix the neck insert 20' to the body. The neck insert 20' may be composed of any suitable material and preferably comprises at least one of: polycarbonate, fiberglass-reinforced epoxy, fiberglass-reinforced thermosetting polyester, nylon, parallam, glass-filled nylon, aluminum, wood and wood-based materials.

As described above, the size and shape of the neck insert will affect the characteristics of the pin. Therefore, the dimensions of the features of the neck insert may be varied for the purpose of adjusting the characteristics of the pin to achieve a desired combination of characteristics. For example, the shoulders may be rounded. Additionally, a lock-in device other than the annular grooves (such as, for example, a protruding rib or other equivalents) may be employed. Or, if grooves are used, the size, shape, and location of the grooves may be varied to achieve desired results.

In FIG. 3D, an alternative embodiment of a neck insert is shown. Similar to the previous embodiment, the neck insert of this alternative embodiment (indicated as 20") includes a body 310", extension 320", rounded portion 330", shoulder 340", and first annular groove 350". Additionally, the neck insert 20" includes a second annular groove 360" disposed between the first annular groove 350" and the shoulder 340". Preferably, the neck insert 20" of the alternative embodiment has the following dimensions: a body 310" outer diameter of approximately 1.350 inches; a body 310" length of approximately 5.630 inches from the shoulder 340" to the tip of the rounded portion 330"; an extension 320" outer diameter of approximately 0.875 inches; an extension 320" length of approximately 1.250 inches; a first annular groove 350" width of approximately 0.180 inches; and a first annular groove 350" depth of approximately 0.080 inches. In implementations, the second annular groove 360" is substantially identical in size and shape to the first annular groove 350", and each is disposed along the body 310" a distance of approximately 1.125 inches from the narrowest point in the neck of the pin. The neck insert 20" may be composed of any suitable material, and preferably comprises at least one of: polycarbonate, fiberglass-reinforced epoxy, fiberglass-reinforced thermosetting polyester, nylon, parallam, glass-filled nylon, aluminum, wood and wood-based materials.

In embodiments, the body is formed around the neck insert 20, as described in greater detail below. As such, the shape of portions of the hollow area 15 will substantially correspond to the shape of portions of the neck insert 20. Accordingly, the shape of the hollow area 15 as described above and hereafter may be varied in order to accommodate the optional neck insert 20 (if the neck insert is used).

Figure 4:
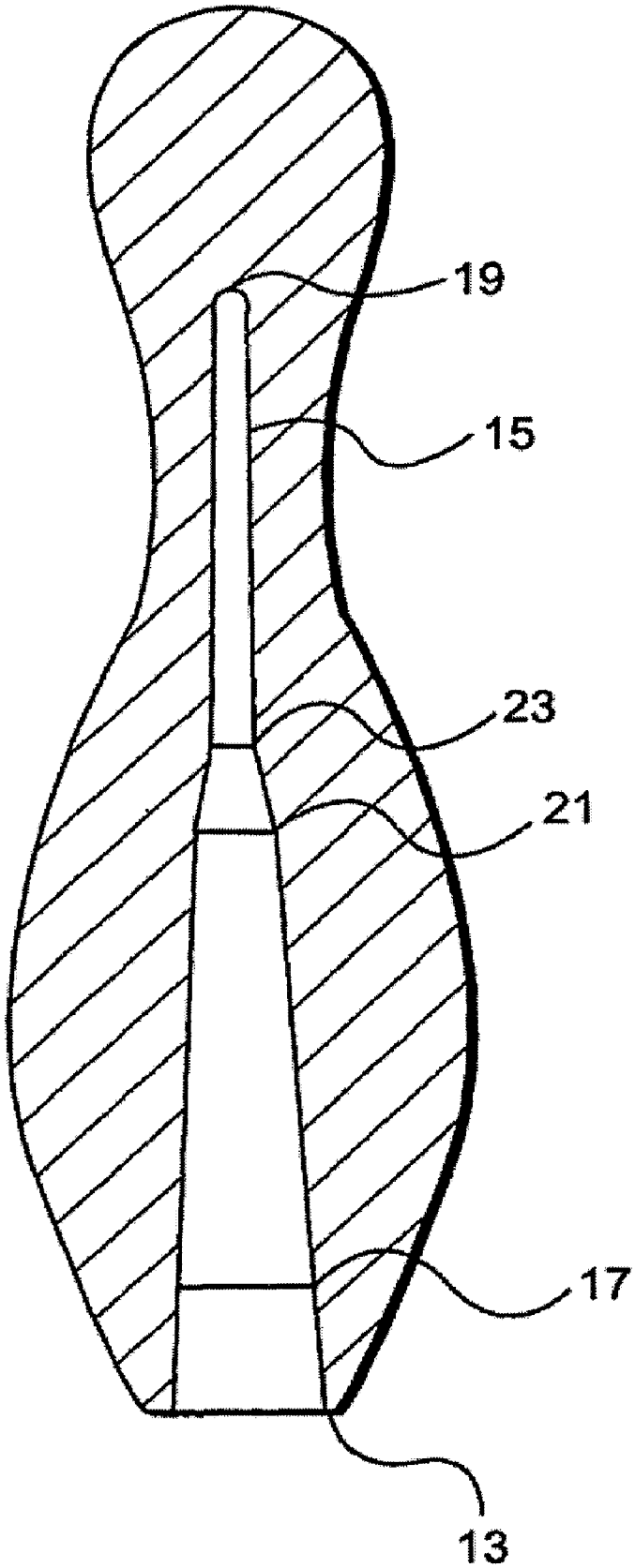
FIG. 4 is a cross-sectional view of another embodiment in accordance with the invention showing a different hollow area.

FIG. 4 shows an alternative embodiment in which the hollow area 15 is similar to that described above but includes additional transitional areas. For example, the hollow area 15 includes the first transition 17, a second transition 21, a third transition 23, as well as the termination point 19. The hollow area 15 has a diameter of approximately 1.600 inches at the bottom of the base 13, and extends inward at a roughly constant diameter of approximately 1.600 inches for a length of approximately 0.750 inches from the bottom 13 to the first transition 17. The second transition 21 has a diameter of approximately 1.375 inches and the third transition 23 has a diameter of approximately 1.188 inches. The termination point 19 has a diameter of approximately 0.625 inches. The distance between the bottom and the second transition is approximately 8.000 inches. The distance between the second transition 21 and third transition 23 is approximately 1.000 inch, and the distance between the third transition 23 and termination point 19 is approximately 5.000 inches. A neck insert may be employed with the embodiment shown in FIG. 4.

In embodiments, the hollow area 15 has a generally conical shape and maintains a generally constant sidewall gradient between the first transition 17 and the second transition 21, the second transition 21 and the third transition 23, and the third transition 23 and the termination point 19. The length of the hollow area 15 between the bottom and the termination point 19 is approximately 14.000 inches.

According to the invention, the mass distribution of the pin is determined by a combination of factors including at least the volume and shape of the hollow area, the volume and shape of the body, and the mass density of the material used to form the body. Thus, to achieve a desired weight, balance, and center of gravity, the hollow area may take different shapes. For example, although the hollow area 15 is described above as preferably having a length of approximately 14.0 inches, it may alternatively have a length in the range of approximately 4.0 inches to 14.0 inches. Also, it is contemplated that the diameter of the hollow area 15 at any location may vary from the values described above in order to achieve a desired weight and balance of the bowling pin.

The bowling pin of the present invention may be composed of any suitable synthetic material. Preferably, the body 3 comprises a unitary piece of homogenous synthetic material. That is, the head, neck, ball line portion, and base are integrally formed of the same synthetic material. In embodiments, the material is a thermoplastic resin and more specifically, the material is ethylene-methacrylic acid (EMAA) copolymer in which the methacrylic acid groups have been partially neutralized with sodium, magnesium ions, zinc or lithium ions. Such a material is sold under the name "SURLYN"™, which is a registered trademark of DUPONT™.

Figure 5:
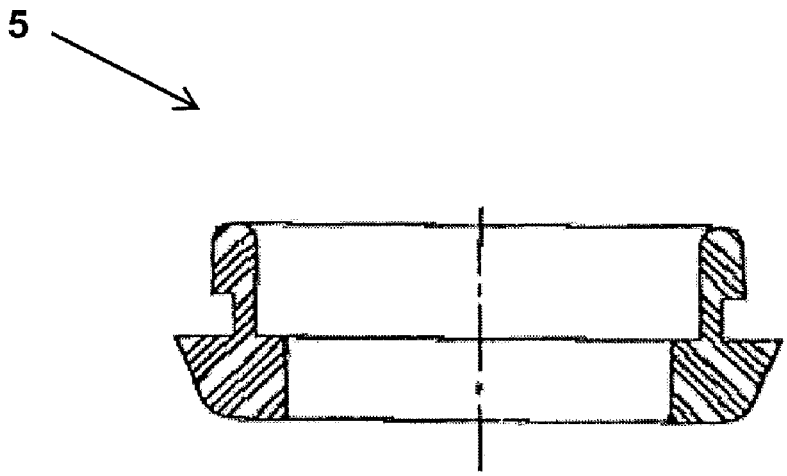
FIG. 5 is a cross-sectional view of a base attachment in accordance with the invention.

The bowling pin of the invention may comprise a base attachment 5 as shown in FIG. 5. The base attachment 5 provides a stable footing for the pin resting upon the flat, horizontal surface of a bowling lane. Unlike conventional base attachments that are integrally attached to a bowling pin body, the base attachment 5 of the present invention may be removably connected to the body 3 so that the base attachment may be removed and replaced as needed. This allows for the replacement of the base attachment 5 instead of the entire pin.

The base attachment 5 of the present invention may be composed of any suitable synthetic material, and preferably comprises nylon or urethane. Moreover, the base attachment 5 may be any suitable size. In embodiments, it has an outer diameter of approximately 2.05 inches at its base. The base attachment 5 further includes an axial bore that is substantially cylindrical and has a diameter of approximately 1.625 inches. In embodiments, the base attachment 5 has a height of approximately 1 inch and can be attached within the hollow area 15 by screw threads or friction fit or other attaching mechanism known to those of skill in the art. Additionally, the base attachment 5 may be designed such that a unique tool is required for its insertion and removal from the body 3.

As described above, the characteristics of the various components (e.g., body, hollow area, neck insert, base attachment) of the pin affect the characteristics of the entire pin. As such, the characteristics of any or all of the components may be varied to achieve desired characteristics of the pin. For example, any combination of the following parameters may be varied to achieve a desired overall bowling pin: body size, body shape, body mass, hollow area shape, location of hollow area, neck insert size, neck insert shape, neck insert location, neck insert mass, base attachment size, base attachment shape, base attachment location, base attachment mass.

Figure 6A:
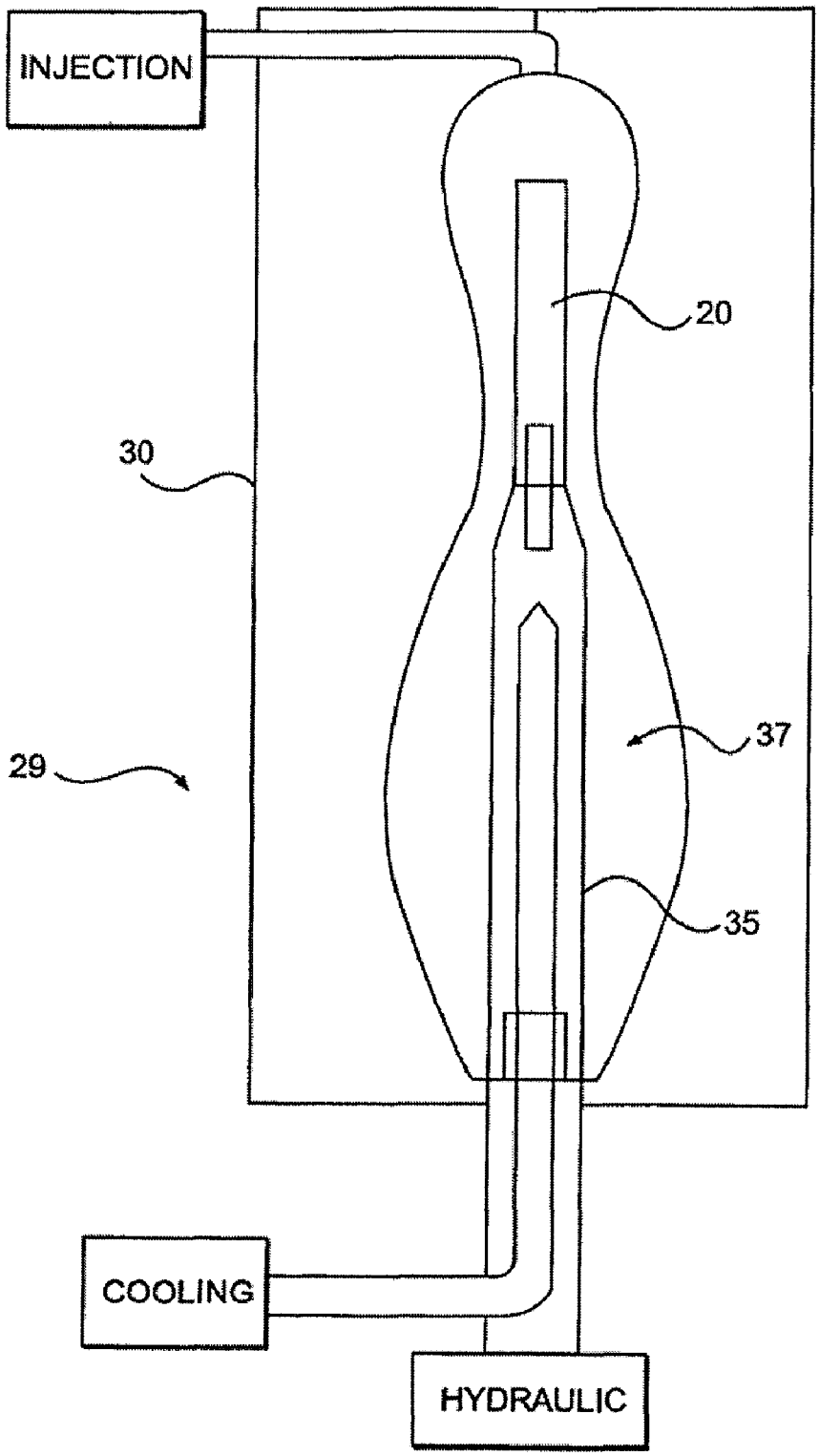
FIGS. 6A and 6B are cross-sectional views of systems used in the method of manufacture of the pin in accordance with aspects of the invention.

FIG. 6A shows a system 29 that may be used to manufacture a bowling pin according to aspects of the invention. In embodiments, the system 29 comprises a mold shell 30 disposed around a mandrel 35, thereby creating a mold cavity 37 between the shell 30 and mandrel 35. The mold shell 30 has an interior in the shape of a bowling pin, such that the mold cavity 37 is in the shape of a bowling pin. The system 29 may include, for example, an injection device for injecting material into the mold cavity, a cooling device for cooling the material in the mold cavity, and a hydraulic device for removing the mandrel from the material in the mold cavity. A neck insert 20 may be disposed atop the mandrel 35, as shown.

Figure 6B:
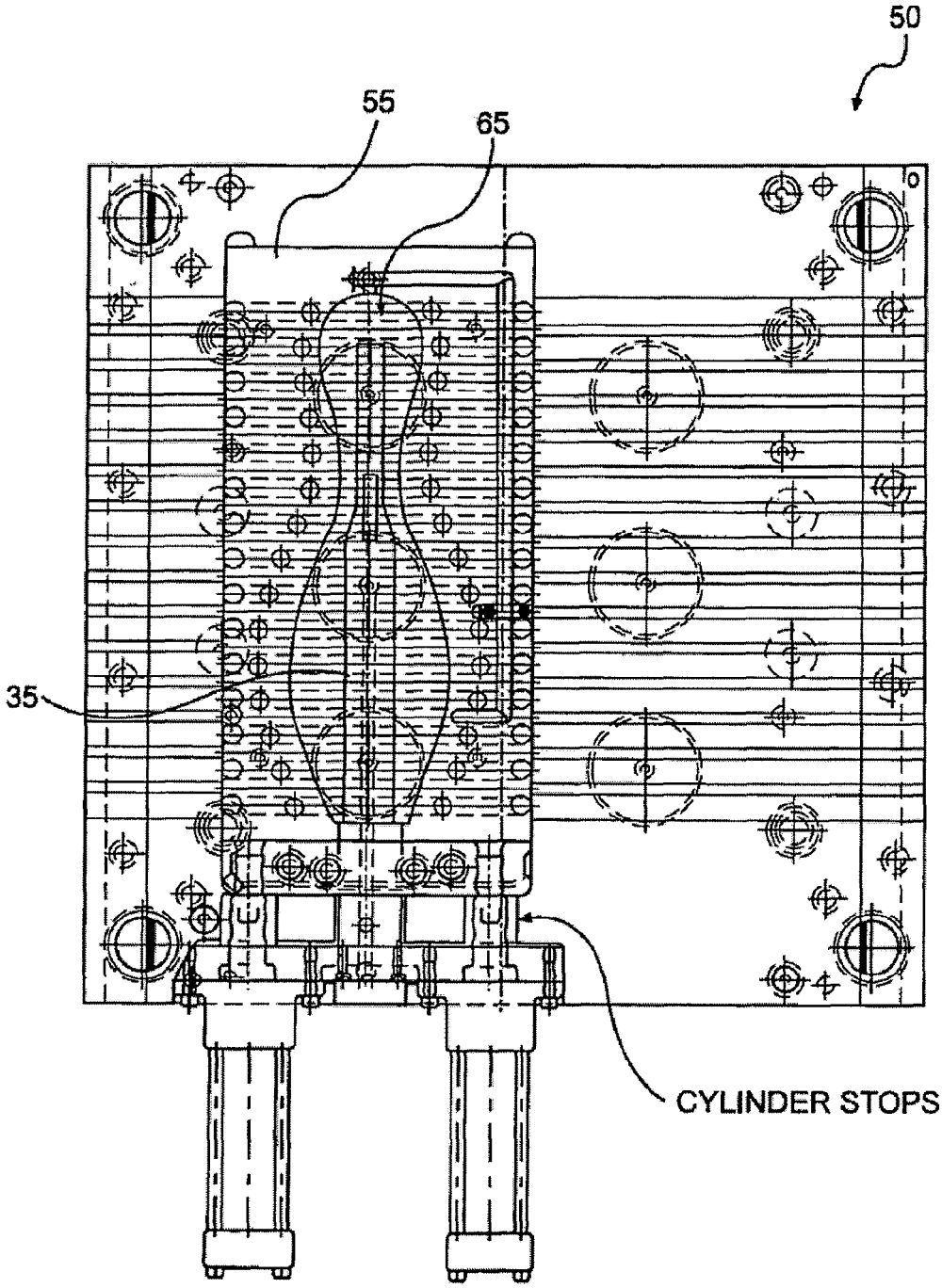

FIG. 6B shows an alternative system 50 that may be used to manufacture a bowling pin according to aspects of the invention. In embodiments, the system 50 comprises a mold shell 55 disposed around a mandrel 35, thereby creating a mold cavity 65 between the shell 55 and mandrel 35. The mold shell 55 has an interior in the shape of a bowling pin, such that the mold cavity 65 is in the shape of a bowling pin. The system 50 may include, for example, an injection devices for injecting material into the mold cavity, a cooling device for cooling the material in the mold cavity, and a hydraulic device for removing the mandrel from the material in the mold cavity. Although a neck insert is not shown in FIG. 6B, it is understood that a neck insert may optionally be employed with the system 50.

Figure 7A:
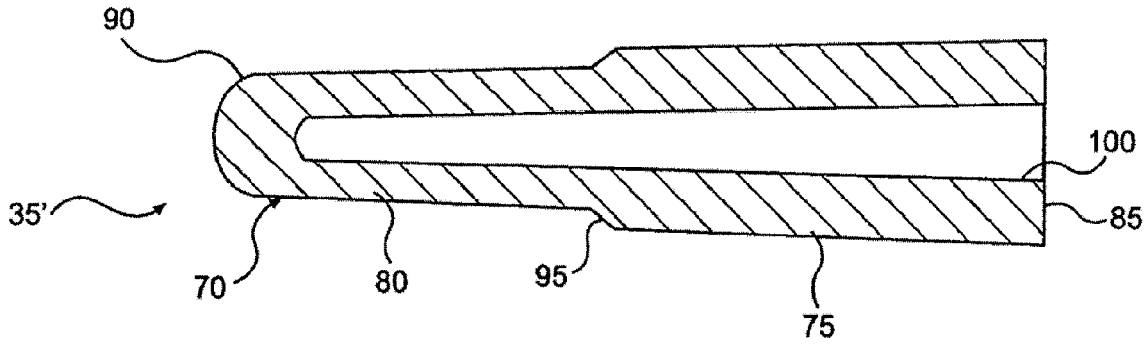
FIGS. 7A and 7B show mandrels according to aspects of the invention.

FIG. 7A shows a first embodiment of a mandrel (indicated as 35') according to implementations of the invention. The mandrel 35' includes a body 70 that substantially defines the shape of the hollow area of the pin. The body 70 may include, for example, a first potion 75 and second portion 80, each having tapered outer walls. The first potion 75 comprises a mandrel base 85. The second portion 80 includes a rounded end 90. The first portion 75 and second portion 80 meet at a tapered shoulder 95. A bore 100 extends into the body 70, and may receive coolant for cooling the mandrel 35'.

Figure 7B:
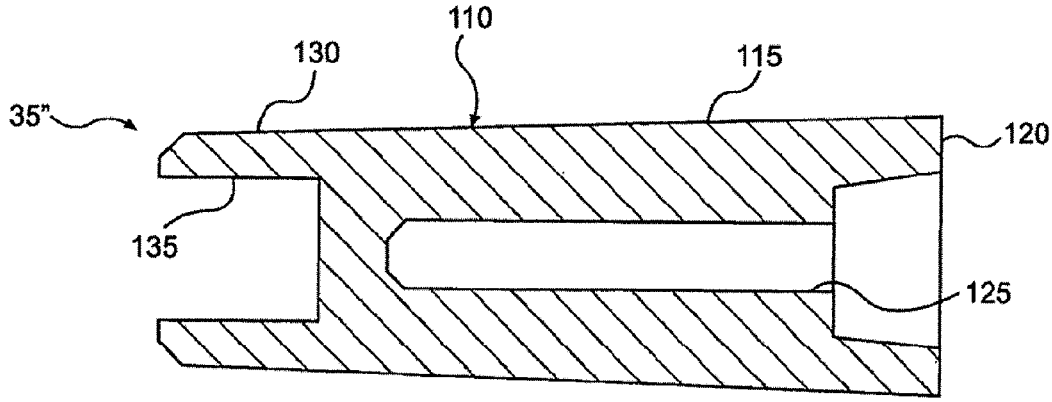

The mandrel of the instant invention is not limited to the shape and design shown in FIG. 7A. More particularly, the mandrel may be any desired size and shape according to the intended pins hollow area size and shape. For example, FIG. 7B shows an alternative embodiment of a mandrel (indicated as 35") according to aspects of the invention. The mandrel 35" includes a body 110 that substantially defines the shape of the internal hollow area of the pin. The body 110 may include, for example, a first portion 115 having a mandrel base 120 and axially bore 125. The body 110 may also include a second portion 130 having a seat 135. In embodiments, the seat 135 corresponds in size to the extension of the neck insert such that the neck insert may be disposed atop the mandrel 35".

Method of Manufacture

Figure 8:
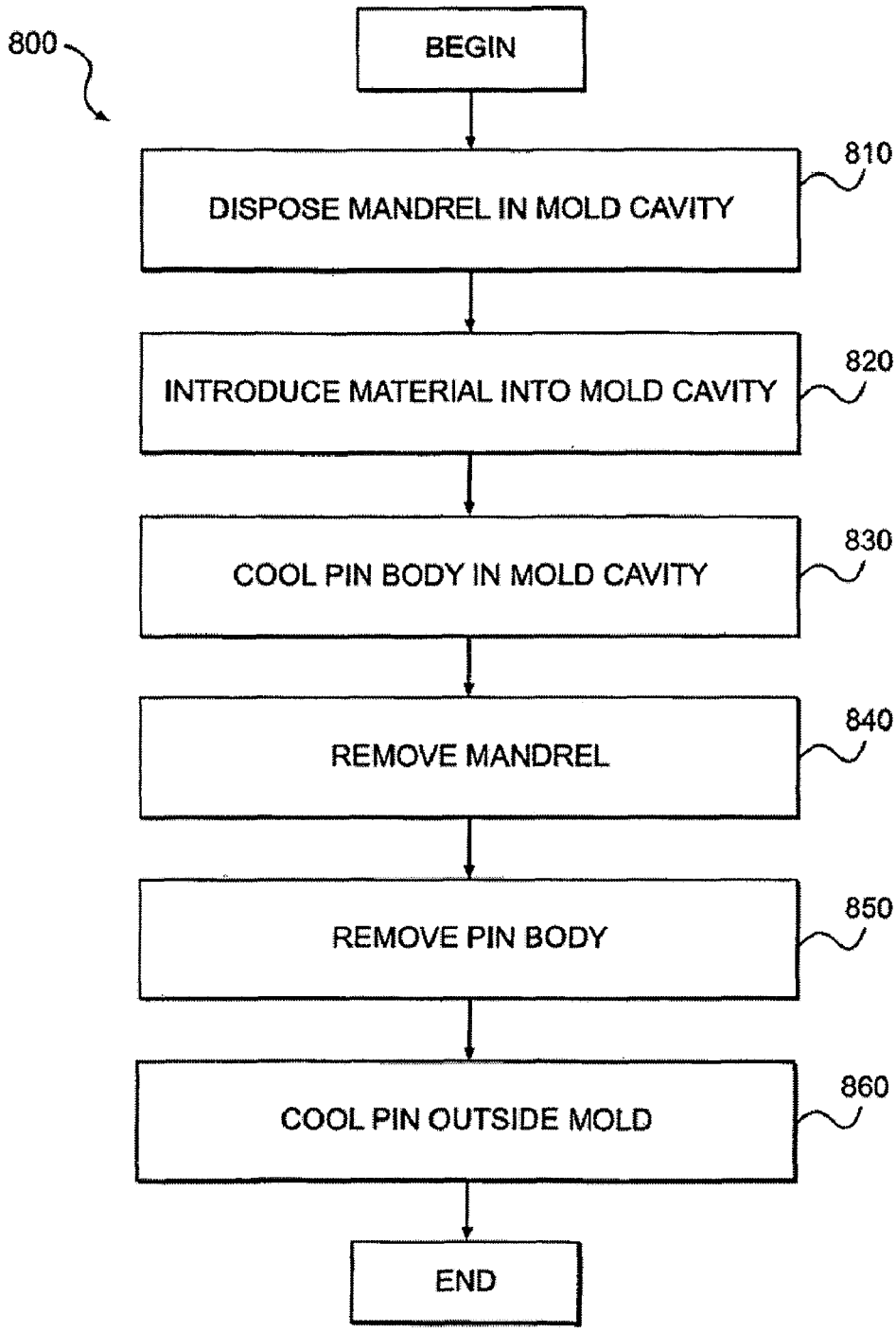
FIG. 8 shows a flow diagram depicting method steps according to aspects of the invention.

FIG. 8 shows a flow diagram depicting steps of a method 800 of manufacturing a bowling pin according to aspects of the invention. At step 810, the mandrel is disposed inside the mold cavity. This may comprise, for example, inserting the mandrel into the mold cavity, or, alternatively, closing the mold cavity around the mandrel.

Step 810 may optionally include installation of a neck insert inside the mold cavity. In embodiments, a portion of a neck insert is connected to a portion of the mandrel that is to be disposed within the mold cavity. The connection may be accomplished in any manner that allows the mandrel to be pulled away from the neck insert when material that forms the pin body is introduced around the neck insert. For example, the neck insert may be connected to the mandrel by friction fit of the extension of the neck insert into the seat of the mandrel.

At step 820, the material that forms the pin is introduced into the mold cavity. In embodiments, this is accomplished via injection molding, as is known in the art, although any suitable technique for introducing the material into the mold cavity may be used. The material fills the mold cavity around the mandrel (and around the neck insert, if one is used). As noted above, the material preferably comprises SURLYN™ Furthermore, while a foaming agent may be added to the material, it is preferable that no foaming agent be used in accordance with the invention.

If a neck insert was used in step 810, then step 820 may optionally include heating the neck insert to an elevated temperature before introducing the material. For example, a neck insert comprising aluminum, or other metal, may be heated to a temperature of at least 200° F., and preferably 300° F., shortly before introducing the material into the mold. Empirical observation has revealed that SURLYN™ forms a strong bond with heated aluminum. It should be noted, however, that the invention may be practiced without heating the neck insert.

At step 830, the material within the mold cavity (i.e., the pin body) is cooled. This may be accomplished by cooling the mold shell and/or mandrel in any suitable manner, as should be apparent to those of ordinary skill in the art. In embodiments, both the mold shell and mandrel are liquid-cooled by circulating a cooling liquid through passages disposed within the shell and mandrel. The cooling liquid used in the shell may be the same or a different temperature as the cooling liquid in the mandrel. This allows the precise control of the cooling rate of different portions of the pin body. Preferably, the cooling liquid of the mandrel is introduced at about 42° to 64° F., and the cooling liquid of the shell is introduced at about 42° to 64° F. The cooling liquid for both the shell and mandrel is preferably water. The pin body is cooled inside the mold for about 6 to 8 minutes.

At step 840, the mandrel is removed from the pin body. In embodiments, this is accomplished using a hydraulic apparatus that applies a force for extracting the mandrel from the body. Other methods for removing the mandrel may be employed, as should be apparent to the skilled artisan. If a neck insert is used in step 810, the neck insert remains within the body as the mandrel is removed due to the nature of the connection between the neck insert and the mandrel.

At step 850, the body is removed from the mold shell. This may be accomplished in any suitable manner, as should be apparent to the skilled artisan. In embodiments, the body is removed from the mold by separating the mold shell components (e.g., by separating halves of the mold shell) and extracting the body.

At step 860, the body is cooled again. This cooling may be accomplished in any known manner, such as, for example, air-cooling, liquid shower, or liquid bath. In embodiments, the body is cooled in a water bath or shower at a temperature of about 80° to 110° F. for a duration of about 55 to 65 minutes.

After step 860, in one implementation of the invention, the pin is substantially ready for use with no additional molding or machining steps required. For example, the final shape of the hollow area is predetermined by the shape of the mandrel (and neck insert, if one is used), and no additional machining is required in the hollow area. Also, the exterior surface does not need to be covered with another layer of material, and does not need to be machined in any way. All that remains is to apply typical decorations such as neck stripes, logos, indicia, etc. In further embodiments, additional molding and/or machining processes may be performed to eliminate any imperfections in the pin.

The foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method of manufacturing a bowling pin, comprising:
providing a mold shell having a mold cavity shaped substantially as a bowling pin;
connecting a neck insert to an end of a mandrel;
disposing the connected mandrel and neck insert inside the mold cavity;
introducing material into the mold cavity;
cooling the material inside the mold cavity;
removing the mandrel from the mold cavity;
removing the material from the mold cavity; and
cooling the material outside the mold cavity,
wherein the material is formed into a body comprising a generally conical internal hollow area and an exposed exterior surface of the bowling pin having a head, neck, ball line portion, and base, and
wherein the removing the mandrel from the mold cavity comprises the neck insert remaining at the neck of the bowling pin.

2. The method of claim 1, wherein the removing the mandrel from the mold cavity comprises disconnecting the neck insert from the mandrel such that the neck insert is not removed from the material.

3. The method of claim 1, wherein the cooling the material inside the mold cavity comprises introducing coolant into at least one passage contained within the mandrel.

4. The method of claim 3, wherein the cooling the material inside the mold cavity further comprises introducing another coolant into at least one passage contained within the mold shell.

5. The method of claim 1, wherein the introducing the material comprises injecting a synthetic material into the mold cavity.

6. The method of claim 5, wherein the material comprises ethylene-methacrylic acid copolymer.

7. The method of claim 1, wherein the removing the mandrel from the mold cavity comprises applying a force with a hydraulic device.

8. The method of claim 1, further comprising attaching a base attachment that can be removed and replaced.

9. The method of claim 1, wherein the connecting the neck insert to the end of the mandrel comprises inserting an extension of the neck insert into a seat of the mandrel.

10. The method of claim 1, wherein the neck insert comprises a lock-in feature that engages the material to affix the neck insert to the body of the bowling pin.

11. The method of claim 10, wherein the lock-in feature comprises an annular groove located between a shoulder and a rounded end of the neck insert.

12. The method of claim 1, wherein the material is formed around the neck insert such that:
the neck insert is disposed in the hollow area,
an end of the neck insert contacts the material at a termination end of the hollow area, and
the neck insert extends from the termination end to a portion of the bowling pin having a smallest diameter between the head and ball-line portion of the bowling pin.

13. The method of claim 1, wherein the removing the mandrel from the mold cavity is performed before the removing the material from the mold cavity.

14. The method of claim 1, wherein the neck insert comprises metal and further comprising heating the neck insert to at least 200 degrees Fahrenheit before introducing the material into the cavity.

15. The method of claim 1, further comprising selecting a size and shape of the mandrel and a size, shape, weight, material and location of the neck insert to achieve a desired neck strength, weight, and mass distribution of the bowling pin, and
wherein the disposing the connected mandrel and neck insert inside the mold cavity comprises locating the neck insert at a location inside the mold cavity that corresponds to the neck of the bowling pin.

16. The method of claim 15, wherein:
the material comprises ethylene-methacrylic acid copolymer,
the neck insert comprises at least one of polycarbonate, fiberglass-reinforced epoxy, fiberglass-reinforced thermosetting polyester, nylon, parallam, glass-filled nylon, aluminum, wood, and wood-based material, and the desired weight is 3.375 to 3.625 pounds and the desired mass distribution comprises a center of gravity at a height of 5.625 to 5.937 inches.

17. A method of manufacturing a bowling pin, comprising:

providing a mold shell having a mold cavity shaped substantially as a bowling pin;

connecting a neck insert to an end of a mandrel;

disposing the mandrel inside a mold cavity, introducing a material comprising ethylene-methacrylic acid copolymer into the mold cavity;

cooling the material inside the mold cavity;

removing the mandrel from the mold cavity;

after the removing the mandrel from the mold cavity, removing the material from the mold cavity; and cooling the material outside the mold cavity, wherein the material is formed into a body comprising a generally conical internal hollow area and an exposed exterior surface of the bowling pin, selecting a size and a shape of the mandrel to achieve a predetermined shape of the hollow area such that: the hollow area extends from a base of the bowling pin to a termination point within the bowling pin, the hollow area has a constant diameter from the base of the bowling pin to a transition location, and the hollow area has a sidewall having a generally constant gradient extending from the transition location to another transition location or the termination point, and the disposing the mandrel inside the mold cavity comprises arranging the neck insert at a location within the mold cavity that corresponds to a neck of the bowling pin and the body of the bowling pin is formed around the neck insert.

18. The method of claim 17, wherein an end of the neck insert contacts the material at a termination end of the hollow area.

19. The method of claim 17, wherein:

the neck insert comprises a body, an extension at a first end of the body, and a rounded portion at a second end of the body opposite the first end, the termination end of the hollow area comprises a rounded shape in contact with and corresponding to the rounded portion of the neck insert, the mandrel comprises a seat corresponding in size to the extension such that the neck insert is disposed atop the mandrel, an axial length of the neck insert is less than half an axial length of the hollow area, the neck insert extends from the termination end to a portion of the bowling pin having a smallest diameter between a head and ball-line portion of the bowling pin, and the neck insert is designed such that the bowling pin as a whole has a weight in a range of about 3 pounds and 6 ounces to about 3 pounds and 10 ounces.

20. The method of claim 17, wherein:

the cooling the material inside the mold cavity comprises introducing coolant at about 42 degrees Fahrenheit to 64 degrees Fahrenheit into at least one passage contained within the mandrel, the cooling the material inside the mold cavity further comprises introducing another coolant at about 42 degrees Fahrenheit to 64 degrees Fahrenheit into at least one passage contained within the mold shell, the cooling the material inside the mold cavity is performed for about 6 to 8 minutes, and the cooling the material outside the mold cavity comprises cooling the body in a water bath or shower at a temperature of about 80 degrees Fahrenheit to 110 degrees Fahrenheit for a duration of about 55 to 65 minutes.

21. The method of claim 17, wherein:

the cooling the material inside the mold cavity comprises cooling an inside of the pin via the mandrel and an outside of the pin via the mold shell prior to removing the mandrel and the pin from the mold cavity, and the cooling the material outside the mold cavity comprises cooling the pin using a water bath.

22. The method of claim 17, further comprising selecting the predetermined shape of the hollow area to achieve a desired weight and mass distribution of the bowling pin.

23. The method of claim 22, wherein the desired weight is 3.375 to 3.625 pounds and the desired mass distribution comprises a center of gravity at a height of 5.625 to 5.937 inches.

* * * * *